US005415149A

United States Patent [19]

Derus et al.

[11] Patent Number: 5,415,149

[45] Date of Patent: May 16, 1995

[54] TELESCOPING CABLE GUARD FOR COMPOUND ARCHERY BOW

[75] Inventors: Michael W. Derus, Canandaigua; Kevin R. Mussack, Clifton Springs; Brandelle J. Wiedrich, Canandaigua, all of N.Y.; Robert G. Foulkrod, Troy, Pa.

[73] Assignee: Golden Eagle Archery, Inc., Farmington, N.Y.

[21] Appl. No.: 58,269

[22] Filed: May 10, 1993

[51] Int. Cl.[6] ..... F41B 5/00

[52] U.S. Cl. ..... 124/23.1; 124/88

[58] Field of Search ..... 124/86, 88, 90, 1, 24.1, 124/23.1, 25.6, 91

[56] References Cited

U.S. PATENT DOCUMENTS

| | | | |
|---|---|---|---|
| 4,452,222 | 6/1984 | Quartino et al. | 124/88 X |
| 4,542,732 | 9/1985 | Troncoso | 124/90 X |
| 4,596,228 | 6/1986 | Smity | 124/88 X |
| 4,741,320 | 5/1988 | Wiard | 124/88 X |
| 4,886,038 | 12/1989 | Betters | 124/88 X |
| 4,903,678 | 2/1990 | Walker | 124/90 |
| 4,917,070 | 4/1990 | Townsend | 124/88 X |
| 4,919,108 | 4/1990 | Larson | 124/88 |
| 5,178,122 | 1/1993 | Simonds | 124/88 X |

*Primary Examiner*—Randolph A. Reese
*Assistant Examiner*—Harry C. Kim
*Attorney, Agent, or Firm*—Hoffman Stone

[57] ABSTRACT

A cable guard includes a rod to be fixed to the handle of a compound bow extending from the handle toward the bowstring and positioned laterally offset from the central plane of the bow to keep the tension cables out of the path of an arrow fired by the bow. A tube fits slidably on the rod and carries a pair of pulleys at its distal end, coaxial with the rod and the tube. The first pulley is fixed to the tube, and the second pulley is freely rotatable on the tube. The tension cables are trained respectively into the grooves of the two pulleys on the side of the pulleys opposite from the central plane of the bow. As the bow is drawn the first cable turns its pulley together with the tube in one direction, while the second cable turns its pulley in the opposite direction. Simultaneously, the cables work together to draw the tube axially along the rod away from the handle.

2 Claims, 1 Drawing Sheet

TELESCOPING CABLE GUARD FOR COMPOUND ARCHERY BOW

BACKGROUND

This invention relates to a novel cable guard for compound archery bows, and, more particularly, to a cable guard having a low profile and being less apt to catch on objects in the archer's maneuvering space.

The usual compound bow carries a cable guard consisting, generally, of a rod, or bar mounted on the bow handle and extending toward the bowstring, being offset from the center of the handle to keep the tension cables a little off to one side of the center line of the bow. When the bow is drawn the cables are drawn rearwardly away from the handle and toward the bowstring. The cable guard, therefore, must extend beyond the brace height position of the bowstring, and it can be bothersome due to snagging on vegetation while the archer is, for example, passing through underbrush or the like. Also, some archers seem to dislike the idea of frictional wear on the cables from rubbing against the guard each time the bow is drawn and each time it is fired.

SUMMARY OF THE INVENTION

Briefly, the invention contemplates a telescoping cable guard having a fixed support rod with a tube telescoped over it. The tube is freely rotatable on the support rod and carries two pulleys at its tip. The first of the two pulleys is fixed to the tube, and the second one is freely rotatable on it. The two tension cables of the bow are trained into the grooves of the respective pulleys. As the bow is drawn the first tension cable turns its pulley and the tube with it in one angular direction, while the second tension cable turns the other pulley in the opposite angular direction, Simultaneously, the two cables act together to draw the tube rearwardly along the rod, extending it only as far as needed to accommodate the rearward travel of the cables. When the bow is fired, the opposite action takes place.

Since the cables lie between the handle and the bowstring, and since the cables determine the telescoping extension and retraction of the guard, the guard is always constrained in front of the bowstring (toward the handle) and does not protrude behind it where it would be exposed to catch on obstacles as the archer moves.

BRIEF DESCRIPTION OF THE DRAWING

A presently preferred embodiment of the invention will now be described in conjunction with the drawing, wherein.

DESCRIPTION OF THE PREFERRED EMBODIMENT

Figure 1:
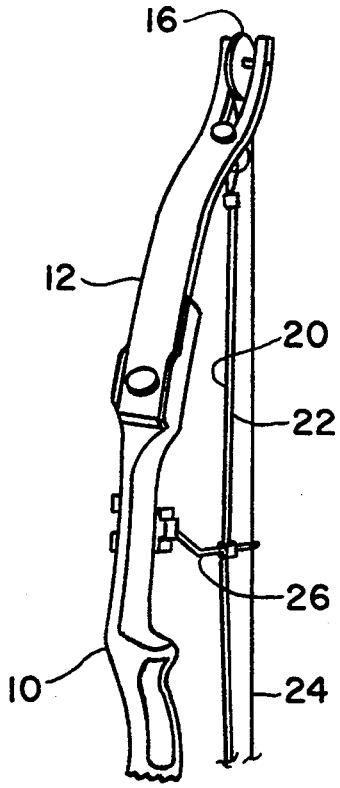
FIG. 1 PRIOR ART
FIG. 1 is a partial view of a typical compound archery bow of the prior art showing the typical cable guard with its offset elbow.

A typical compound bow is shown in FIG. 1, primarily for reference purposes. It includes a handle 10, upper and lower limbs, only the upper one 12 being shown, secured to opposite ends of the handle, eccentric wheel, or cam arrangements 16 at the tips of the limbs, a pair of cables 20 and 22 connected between the wheel, or cam arrangements and the opposite ends of a bowstring 24. Also, a cable guard 26 is mounted on the handle 10 extending rearwardly therefrom toward the bowstring. The guard is shaped with an elbow so that it holds the cables out of the aiming line of the bowstring. The guard 26 is fixed to the handle 10 and has no moving parts of its own. When the bow is not drawn the bowstring is retracted forwardly toward the handle, leaving a part of the cable guard projecting beyond the bowstring where it may snag on nearby vegetation or the like, and is generally an annoyance to the archer.

Figure 2:
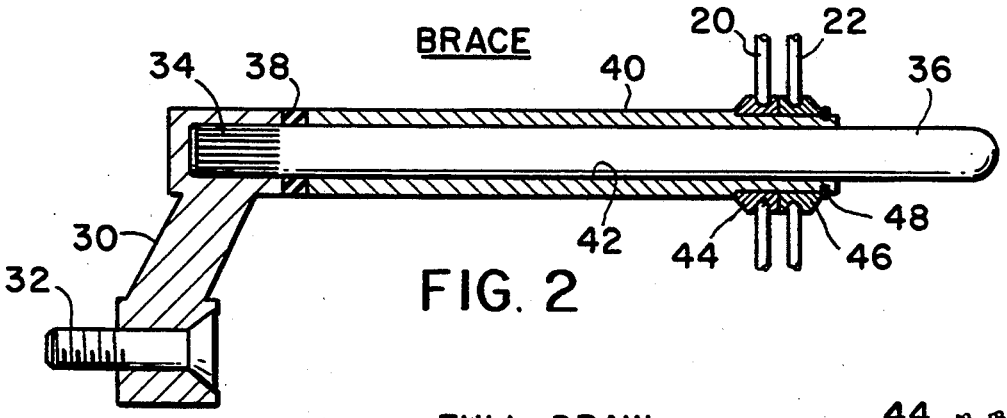
FIG. 2 is a longitudinal, sectional view of a cable guard according to the invention showing the guard in its retracted position.
Figure 3:
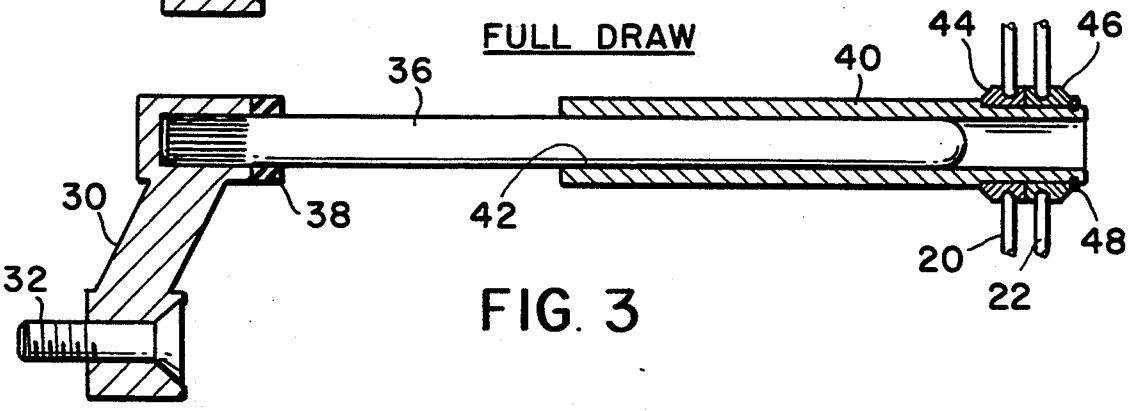
FIG. 3 is a longitudinal, sectional view of the cable guard shown in FIG. 2, but showing the guard in its extended position.

Referring now to FIGS. 2 and 3, a cable guard according to the presently preferred embodiment of the invention includes a mounting support 30 in the form of an elbow offset to position the operative part of the guard away from the central plane of the bow. The proximal end of the support 30 is secured as by a screw 32 to the bow handle 10. Its other end is drawn to form a socket 34 for receiving the proximal end of a rod 36, which may be fixed in the socket 34 as by press fitting. A tubular slide 40 fits over the rod 36 and is freely slidable on it both axially and angularly, and a rubber shock absorber 38 such as an O-ring or an ordinary soft washer is fitted on the rod 36 for minimizing noise and vibration when the slide 40 is driven to engage the support 30. A liner 42 of a low friction material such as the materials sold commercially under the trademarks Teflon and Delrin is secured within the slide 40. Both the rod 36 and the slide 40 fitted on it may be made of aluminum or any other desired material, aluminum being presently preferred because of its light weight and ease of manufacture, A pair of pulleys 44 and 46 are mounted on the slide 40, coaxially with it, at its distal end. The inner pulley 44 is fixed to the slide, while the outer one is rotatable on the slide, The pulleys 44 and 46 are retained by any desired means, such as, for example, by the retainer snap ring 48 shown.

In operation, the guard is mounted on the handle 10 of a bow, in position such that the rod 36 extends from the handle toward the bowstring, As shown, the slide 40 is shorter than the rod 36, and the rod 36 is shorter than the brace height of the bow so that while the bow remains undrawn the rod 36 does not cover the space between the handle and the bowstring, (In fact, at no point in the operating range of the bow does any part of the guard extend even out to the bowstring.)

The tension cables 20 and 22 are restrained in the grooves of the respective pulleys 44 and 46 on the side of the pulleys away from the middle plane of the bow, thereby to hold the cables out of the way of the archer's line of sight and out of the path of the arrow to be fired, When the bow is drawn one cable rotates the inner pulley 44, and the slide 40 along with it, in one angular direction, while the other cable rotates the outer pulley 46 in the opposite angular direction, Simultaneously, the cables draw the slide 40, together with the two pulleys 44 and 46, axially along the rod 36 toward the bowstring, The cables 20 and 22 are tensioned between the tips of the limbs of the bow and because the draw of the bowstring is greater than the movement of the tips of the limbs, as the bow is drawn the bowstring moves faster and farther from the handle than does the distal end of the slide 40.

When the bow is subsequently fired, the action is reversed, and the slide 40 is returned to its starting position on the rod 36.

The turning of the slide 40 by the inner tension cable 20 is believed to contribute to free movement of the slide along the rod; once the slide starts its rotation any possible sticking against axial travel is apparently completely overcome.

There is no wear on the tension cables due to rubbing against the cable guard, and the cable guard is kept always out of the way of nearby obstacles and within the brace height of the bow. The action of the guard is smooth and quiet, under the control of the tension cables, which it follows. And the guard may be easily and quickly disassembled simply by flexing the tension cables out of the pulley grooves, whereupon the slide simply slips off the rod 36.

What is claimed is:

1. A telescoping cable guard for a compound archery bow of the kind having tension cables tensioned between opposite ends of the bow and the ends of a bowstring, the cables supporting the bowstring in tension and lying adjacent thereto, said guard comprising a support rod, means for securing said rod in fixed position at one of its ends on the bow, a telescoping member slidable on said support rod, and cable guide means on said telescoping member for engaging the tension cables of the bow and holding them laterally offset from the bowstring, said telescoping member together with said guide means being reciprocatable lengthwise on said support rod and being driven therealong by the cables during drawing and firing of the bow, said telescoping member being reciprocalable between a position where it is supported along substantially its entire length by said support rod and a second position where it extends in cantilever fashion beyond the end of said rod opposite from said one end.

2. A telescoping cable guard for a compound archery bow of the kind having a central handle, a pair of limbs secured respectively to opposite ends of the handle and extending in opposite directions therefrom in a common plane to form a bow, each of said limbs having a proximal end secured to the handle and a distal end opposite from the proximal end, and cables tensioned between the distal ends of the respective limbs and supported thereby adjacent to the common plane, and a bowstring tensioned by the cables and held thereby at a brace distance from the handle, the cables lying within the brace distance from the handle when the bow is undrawn and spaced from the handle substantially beyond the brace distance when the bow is fully drawn, said guard comprising a support rod fixed at one end to the handle and extending therefrom toward the bowstring, a slide rotatable on said rod and freely slidable therealong toward and away from the handle, first and second pulleys coaxially aligned with said support rod, said first pulley being fixed to said slide adjacent to the end thereof opposite from the handle, said second pulley being rotatable on said slide and on the face of said first pulley opposite from the handle, each of said pulleys having a peripheral groove for receiving one of the cables and being rotated by it responsively to longitudinal travel of the cable, said pulleys lying within the brace distance from the handle when the bow is undrawn and substantially beyond the brace distance when the bow is fully drawn, the cables being operative to rotate the pulleys and to move the slide along the support rod.

* * * * *